US006803880B2

(12) United States Patent
Spiropoulos

(10) Patent No.: US 6,803,880 B2
(45) Date of Patent: Oct. 12, 2004

(54) ANTENNA DEVICE

(75) Inventor: Vasilios Spiropoulos, Lund (SE)

(73) Assignee: Gigaant AB, Lund (SE)

( * ) Notice: Subject to any disclaimer, the term of this patent is extended or adjusted under 35 U.S.C. 154(b) by 0 days.

(21) Appl. No.: 10/450,360

(22) PCT Filed: Dec. 22, 2000

(86) PCT No.: PCT/SE00/02668

§ 371 (c)(1),
(2), (4) Date: Jun. 11, 2003

(87) PCT Pub. No.: WO02/052678

PCT Pub. Date: Jul. 4, 2002

(65) Prior Publication Data

US 2004/0075612 A1 Apr. 22, 2004

(51) Int. Cl.[7] ..... H01Q 1/38
(52) U.S. Cl. ..... 343/700 MS; 343/702; 343/895
(58) Field of Search ..... 343/700 MS, 702, 343/803, 806, 895, 906

(56) References Cited

U.S. PATENT DOCUMENTS 5,363,114 A 11/1994 Shoemaker
5,682,143 A * 10/1997 Brady et al. ..... 340/572.7
6,124,831 A 9/2000 Rutkowski et al.
6,342,869 B1 * 1/2002 Foote ..... 343/841
6,351,241 B1 * 2/2002 Wass ..... 343/702
6,593,900 B1 * 7/2003 Craven et al. ..... 343/895
2002/0129488 A1 * 9/2002 Lieberman ..... 29/600

FOREIGN PATENT DOCUMENTS

DE 299 22 053 3/2000
EP 1 028 483 8/2000

* cited by examiner

*Primary Examiner*—Tan Ho
(74) *Attorney, Agent, or Firm*—Bachman & LaPointe, P.C.

(57) ABSTRACT

An antenna device is designed for incorporation in an electric apparatus and has a radiator carried by a flexible plastic film. The film has a radiator pattern disposed on one side of a configurationally stable plastic carrier, and also a supply conductor which extends to the opposite side of the carrier. The carrier has snap catches for securement direct on the circuit card, and a resilient portion with a projection directed towards the circuit card. The supply conductor covers the projection and thereby realizes contact, galvanically and under spring pretensioning, with a contact point, a so-called pad, on the circuit card.

10 Claims, 4 Drawing Sheets

ANTENNA DEVICE

TECHNICAL FIELD

The present invention relates to an antenna device which includes a radiator disposed on a flexible film, the film being secured on a carrier.

BACKGROUND ART

A plurality of antenna constructions are known in the art in which the radiator proper is disposed on a flexible, occasionally self-adhesive film. Such an antenna may, for example, be wound up into a roll which is secured on a tubular carrier, but may also be inserted in a tubular casing. In both cases, such an antenna is generally disposed on the outside of the electric apparatus, for example a cell or mobile telephone, which the antenna is to serve.

In the above-described types of antennas, a supply conductor is required between the antenna and the circuit card or circuit cards which the electric apparatus contains. In particular the connection between the supply conductor and the circuit card requires a complicated and expensive connection arrangement.

It is also known in the art to incorporate an antenna in an electric apparatus, the antenna being produced on a flexible film. Such an antenna is often secured on the inside of the casing of the apparatus and is provided with a supply conductor which is connected to the circuits of the apparatus on its circuit card. Also in such situations, a connection arrangement is required for connecting the antenna to the circuits.

PROBLEM STRUCTURE

The present invention has for its object to design the antenna device intimated by way of introduction such that the drawbacks inherent in prior art designs and constructions are obviated. In particular, the present invention has for its object to obviate the need for a connection arrangement specifically disposed on the circuit card and also, as far as is possible, to obviate the need for a specific supply conductor. The present invention further has for its object to design the antenna device such that it is simple and extremely economical to manufacture as well as being extremely simple to mount in place.

SOLUTION

The objects forming the basis of the present invention will be attained if the antenna device intimated by way of introduction is characterised in that the carrier has fixing members for securing on a circuit card and that the radiator extends with at least a portion to that side of the carrier facing towards the circuit card in order there to realise galvanic contact with a contact point disposed on the circuit card.

BRIEF DESCRIPTION OF THE ACCOMPANYING DRAWINGS

The present invention will now be described in greater detail hereinbelow with particular reference to the accompanying Drawings. In the accompanying Drawings.

DESCRIPTION OF PREFERRED EMBODIMENT

Figure 3:
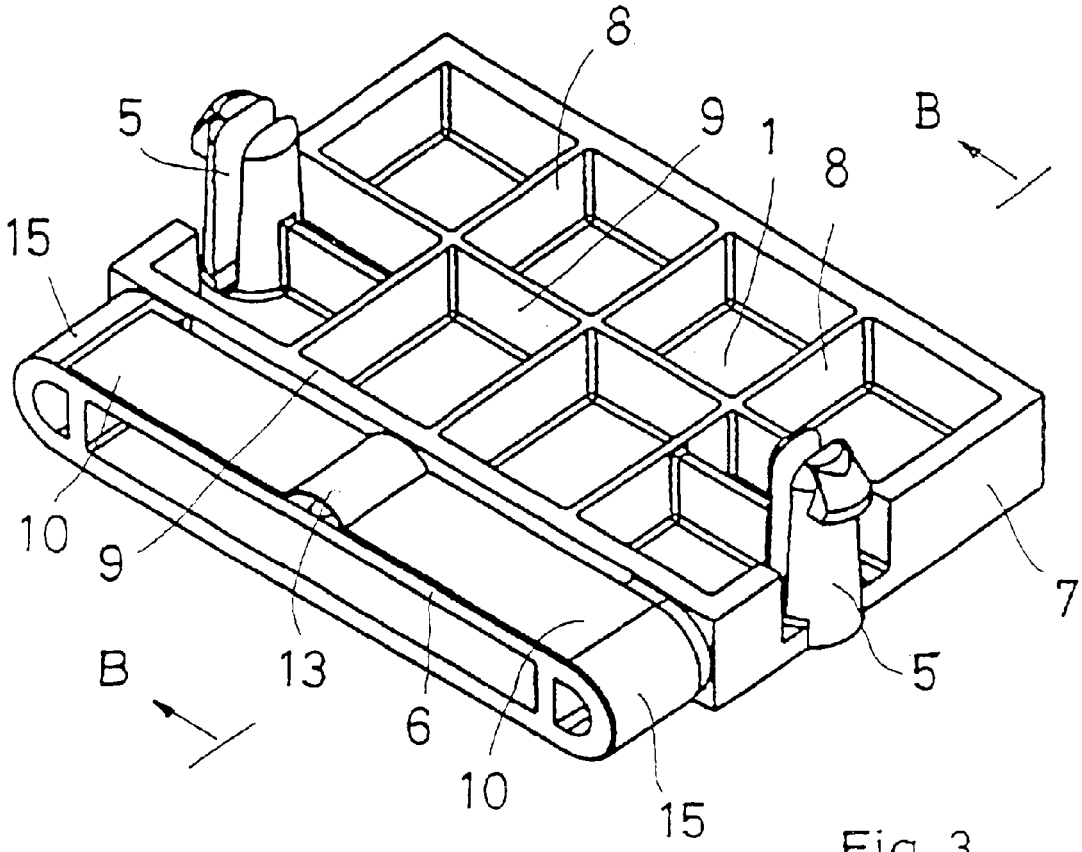
FIG. 3 shows the antenna device of FIG. 1 in perspective, seen from beneath.

In the description given below of the present invention, terms such as 'upper side', 'lower side', 'upwards' and 'downwards will be employed. The term 'upper side' is here taken to signify that side in the antenna device which faces away from the circuit card to which the antenna device is secured. Correspondingly, the term 'lower side' is taken to signify that side which is turned to face towards the circuit card regardless of how the circuit card is oriented in space. Employing the above definition, FIG. 1 shows in perspective the upper side of an antenna device, while FIG. 3 shows the lower side of the same antenna device.

Figure 1:
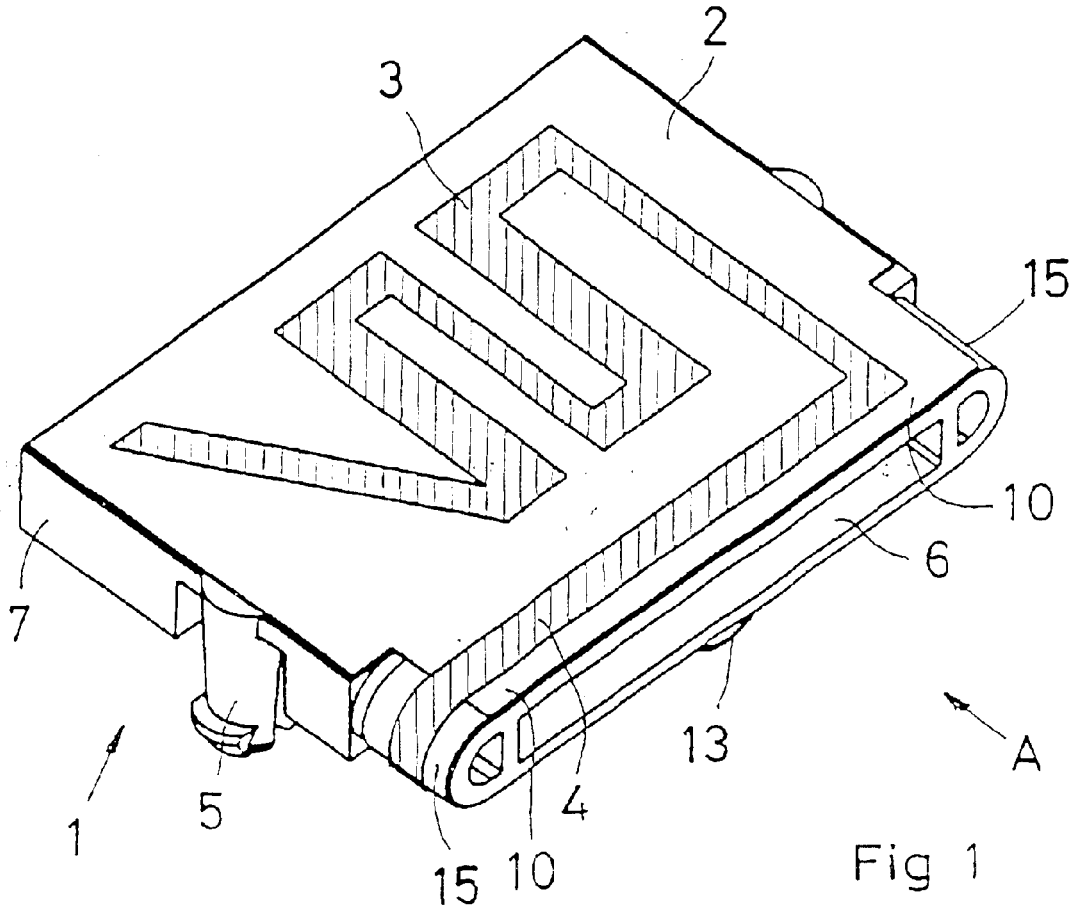
FIG. 1 is a perspective view from above of a first embodiment of the antenna device.
Figure 2:
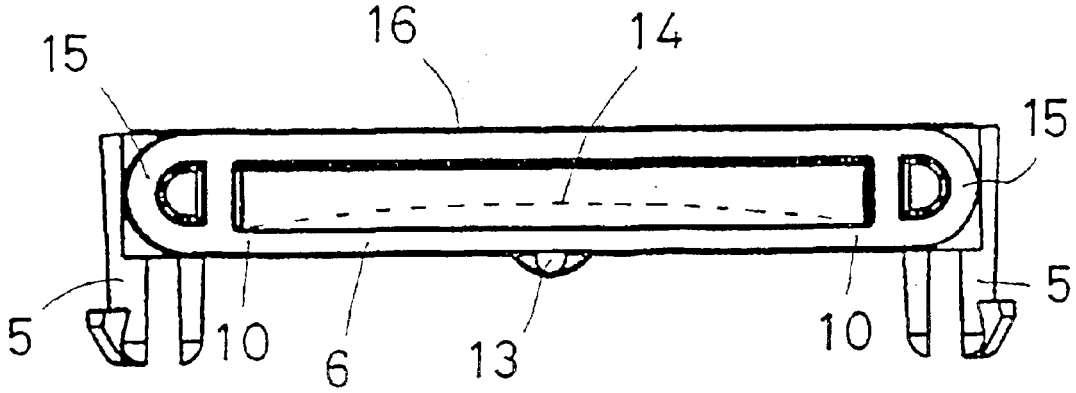
FIG. 2 is a view of the antenna device of FIG. 1 in the direction of the arrow A.

The antenna device according to FIG. 1 has a carrier 1 which is manufactured from plastic and on which a flexible film 2 is secured, which may have a radiator pattern 3 and a supply conductor 4. The radiator pattern 3 and the supply conductor 4 are residues of a thin metal layer which originally covered the whole of the flexible film 2. On its rear side or lower side, the carrier 1 has fixing members 5 in the form of snap catches which are intended for securing the carrier in corresponding apertures in the circuit card on which the antenna device is to be mounted.

The production of the radiator pattern and the supply conductor may be put into effect according to known technology methods, for example by etching of a plastic film which has been coated with a thin, conductive metal layer, in which the pieces of the metal layer which are not to be employed are etched away. Further, a protective plastic foil is generally disposed on the outside of the flexible film with the radiator pattern 3 and the supply conductor 4.

In its most generic form, the present invention implies that the radiator, which includes both the radiator pattern 3 and the supply conductor 4, extends with a portion to the lower side of the carrier in order there to make contact with a contact point, a so-called pad, on the circuit card. In such instance, it is only necessary to produce the contact point or pad proper on the circuit card. On the other hand, no complex connection contact arrangement is required.

For the galvanic contact between the radiator and the contact point or pad of the circuit card to be maintained, a resilient function is embodied in the carrier 1 which resiliently pretensions that portion of the radiator which is to maintain contact with the pad, against this and the circuit card. In such instance, the resiliently flexible properties in the material from which the carrier 1 is produced are utilised.

For the carrier in its entirety not to be deformed under the action of the above-mentioned spring force, it has a specific resilient portion 6 and a configurationally stable main portion 7 which carries the radiator pattern 3 proper.

The main portion 7 has a planar upper side 16 on which the flexible film 2 with the radiator pattern 3 is secured. The main portion 7 further has, on its lower side, a number of rigidifying ribs 8, 9, which, in the embodiment according to FIG. 3, intersect one another approximately at right angles. Further, the main portion has a circumferential frame which may also be described as consisting of rigidifying ribs. The lower edges of the rigidifying ribs 8 and 9 and the circumferential frame lie in a common plane and are intended to rest against the one side of the circuit card on which the antenna device is to be snapped in place.

Figure 4:
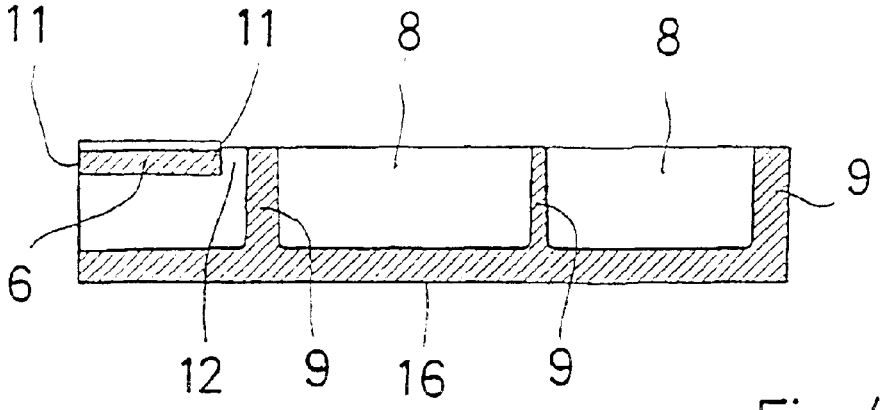
FIG. 4 is a section through the antenna device, taken along the line B—B.

In the embodiment according to FIG. 3, the resilient portion 6 is long and narrow in configuration and is connected to, the main portion 7 at its short ends 10. The two opposing longitudinal sides 11 (FIG. 4) are free from the remainder of the carrier 1. Along the one longitudinal side 11, there is provided an elongate gap 12 between the longitudinal side and the adjacent rigidifying rib 9.

In the embodiment according to FIGS. 1–4, the resilient portion 6 has, on its lower side, i.e. the side facing towards the circuit card and the pad or contact point disposed thereon, a projection 13 which is intended to urge the supply conductor into good galvanic contact with the pad. The projection 13 extends beneath the plane which is formed by the lower edges of the rigidifying ribs 8 and 9 of the main portion 7, which implies that, on mounting of the carrier 1 on the circuit card, the resilient portion 6 will be pressed upwards as intimated by the broken line 14 in FIG. 2.

After practical trials, on the one hand with different material qualities, and, on the other hand, with different dimensioning of the resilient portion 6, it has been found that, in a suitable version, a spring force will be achieved of the order of magnitude of 4 N when a newly-manufactured carrier is placed on a circuit card. After a while, this spring force fades to approximately 1 N, in order than to stabilise and remain constant. A spring force of 1 N is fully sufficient to guarantee a reliable galvanic contact between the contact point or pad of the circuit card and the supply conductor 4. On the other hand, this spring force or contact force is not so great as to risk deforming the carrier 1 in its entirety or possibly also the circuit card.

As is apparent from the Drawings, the carrier 1 has gently arched edge regions 15. The supply conductor 4 extends from the left-hand gently arched region 15 in FIG. 1 on both sides of the carrier 1, i.e. with one portion up to its upper side with the radiator pattern 3, and with one portion down to the lower side of the carrier and up to and past the projection 13 so that the portion of the supply conductor 4 which covers the projection 13 forms the contact point of the antenna against the circuit card. As a result of the gently arched edge region 15 of the carrier 1, there is no risk of damage to the flexible film or the thin metal layer which constitutes the supply conductor 4 disposed thereon.

The embodiment according to FIGS. 5–8 does not differ in principle from the embodiment according to FIGS. 1–4, but displays a different detailed construction. Thus, in this embodiment, the carrier 1 is longer and narrower than that which applies in the previous embodiment. In this embodiment, the carrier has a substantially planar upper side 16 on which the flexible film with the radiator pattern 3 and the supply conductor 4 is secured. In the one short end, the carrier 1 has the gently arched region 15 around which the supply conductor 4 is passed so that it will have a portion on the lower side of the carrier at least as far as to cover the projection 13.

Figure 5:
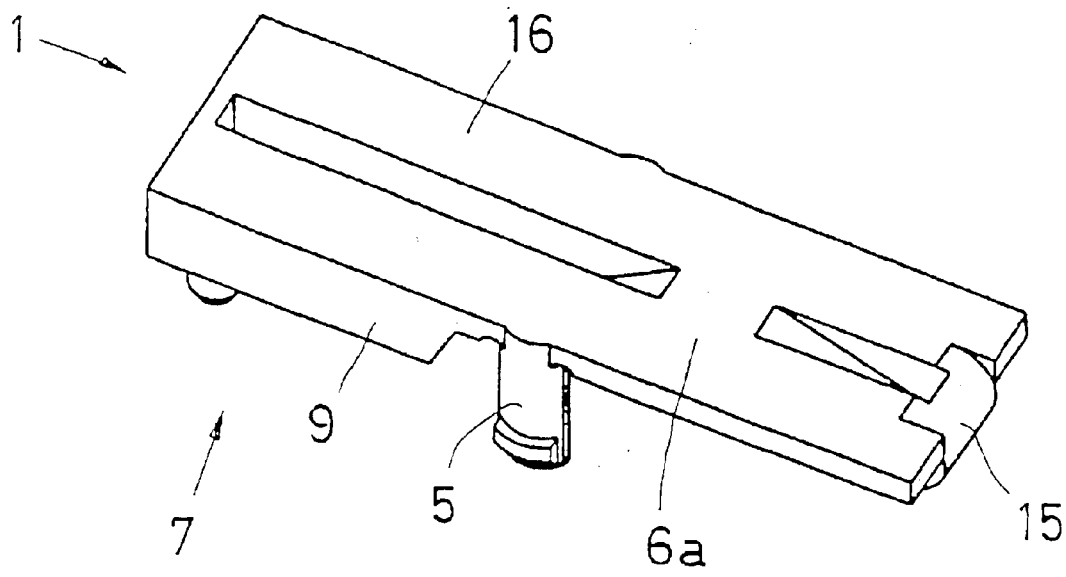
FIG. 5 is a perspective view from above of a second embodiment of the device according to the present invention.
Figure 6:
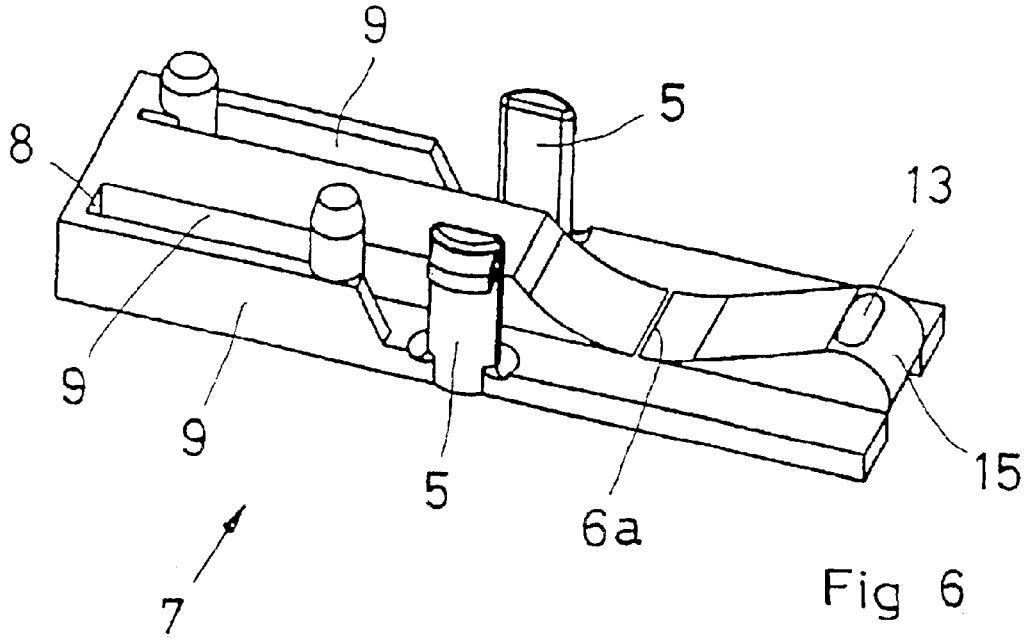
FIG. 6 is a perspective view from beneath of the antenna device according to FIG. 5.
Figure 7:
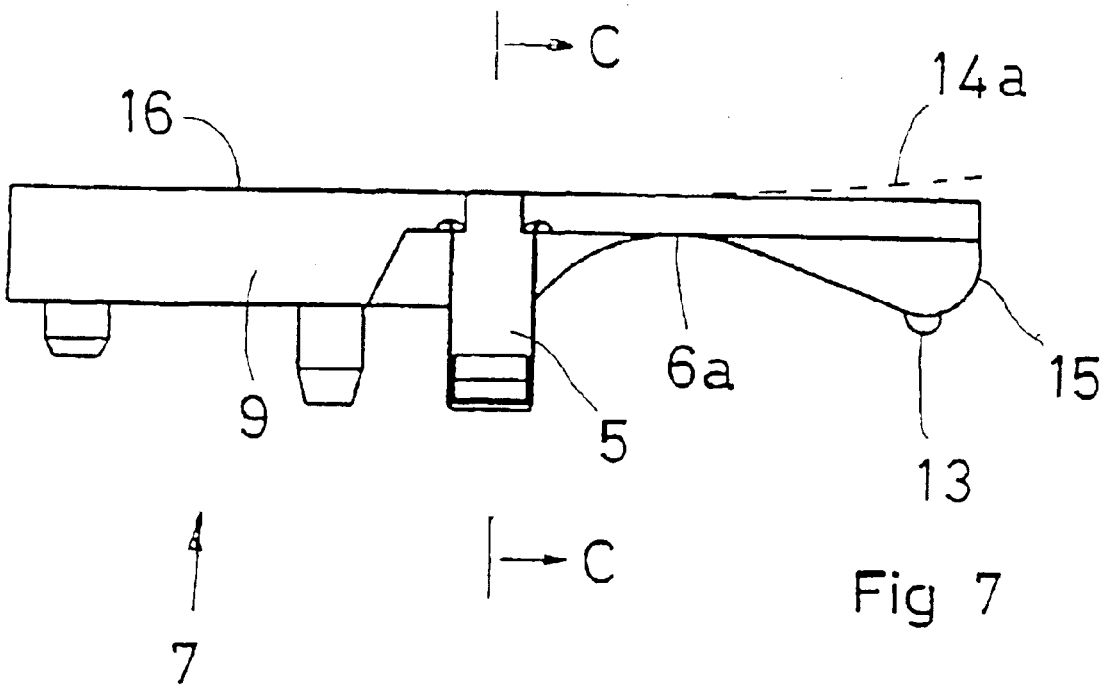
FIG. 7 is a straight side elevation of the antenna device of FIG. 5.
Figure 8:
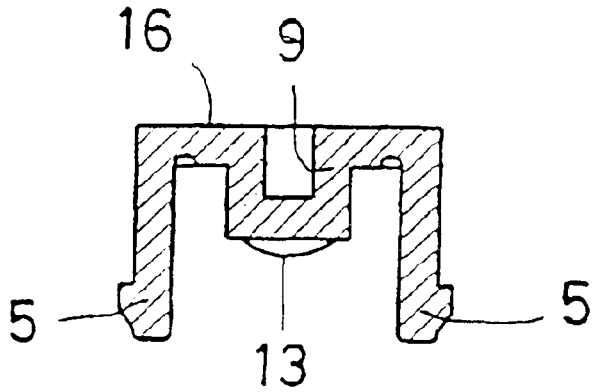
FIG. 8 is a section taken along the line C—C in FIG. 7.

In FIGS. 5, 6 and 7, the carrier 1 has, in its left-hand end, a configurationally stable main portion 7, while the resilient portion 6*a* in this embodiment is designed as a thin portion of the carrier, this portion being thin in a direction towards and away from the circuit card and wholly lacking rigidifying ribs so that the portion of the carrier 1 lying outside the resilient portion 6*a* may be bent away from the circuit card in accordance with the broken line 14*a* in FIG. 7, and thereby realise a spring or contact force between the part of the supply conductor lying on the projection 13.

What is claimed is:

1. An antenna device comprises a radiator disposed on a flexible film (2), the film is secured on a carrier C(1), wherein the carrier (1) has fixing members (5) for securing on a circuit card; and the radiator extends with at least a portion to a side of the carrier facing towards the circuit card in order there to realise galvanic contact with a contact point disposed on the circuit card.

2. The antenna device as claimed in claim 1, wherein the radiator includes a radiator pattern (3) and a supply member (4), the supply member being located on the side of the carrier C(1) facing towards the circuit card for contact with the contact point, and the radiator pattern (3) is located on an opposite side (16) of the carrier.

3. The antenna device as claimed in claim 2, wherein the carrier (1) has a gently rounded edge portion (15) around which the flexible film (2) extends in both directions to the opposite side (16) and to the side facing the circuit card.

4. A The antenna device as claimed in claim 2, wherein the carrier has, on its side facing towards the circuit card, a strip-shaped long, narrow resilient portion (6) which is connected to the carrier (1) at its opposing short ends (10), but which is otherwise free from the carrier along its longitudinal sides (11).

5. The antenna device as claimed in claim 4, wherein the side of the resilient portion (6) facing towards the circuit card has a projection (13).

6. The antenna device as claimed in claim 1, wherein the portion (6) of the carrier (1) which supports the portion of the radiator in contact with the contact point is spring pretensioned towards the contact point by resilience in the material of the carrier.

7. The antenna device as claimed in claim 6, wherein the carrier (1) has a thin resilient portion (6*a*) seen in a direction towards and from the circuit card.

8. The antenna device as claimed in claim 1, wherein the carrier (1) has snap catches (5) for securing in corresponding apertures in the circuit card.

9. A The antenna device as claimed in claim 1, wherein the carrier (1) has, on its side facing towards an end of the circuit card, a number of rigidifying ribs (8, 9).

10. The antenna device as claimed in claim 1, wherein the portion (6) of the carrier (1) abuts on the one side against the portion of the flexible film (2) in contact with the contact point, and has a projection (13) directed towards the circuit card.

* * * * *

UNITED STATES PATENT AND TRADEMARK OFFICE

CERTIFICATE OF CORRECTION

PATENT NO. : 6,803,880 B2
DATED : October 12, 2004
INVENTOR(S) : Vasilios Spiropoulos It is certified that error appears in the above-identified patent and that said Letters Patent is hereby corrected as shown below:

Column 4,
Lines 16 and 25, after the word "carrier" the "C" should be deleted.
Line 32, before the word "The" the "A" should be deleted.

Signed and Sealed this

Nineteenth Day of April, 2005

JON W. DUDAS
*Director of the United States Patent and Trademark Office*